US006672119B2

(12) United States Patent
Minnerop et al.

(10) Patent No.: US 6,672,119 B2
(45) Date of Patent: Jan. 6, 2004

(54) AXIAL-POSITION ADJUSTMENT FOR PROFILED ROLLING-MILL ROLLS

(75) Inventors: Michael Minnerop, Ratingen (DE); Hans-Jürgen Reismann, Düsseldorf (DE); Helmut Terhart, Bocholt (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/081,888

(22) Filed: Feb. 21, 2002

(65) Prior Publication Data

US 2003/0010083 A1 Jan. 16, 2003

(30) Foreign Application Priority Data

Feb. 27, 2001 (DE) ..... 101 09 443
Nov. 27, 2001 (DE) ..... 101 58 140

(51) Int. Cl.[7] ..... B21B 37/58; B21B 31/18

(52) U.S. Cl. ..... 72/10.4

(58) Field of Search ..... 72/10.6, 14.1, 72/9.5, 10.1, 10.4, 10.7, 12.1, 247; 700/148

(56) References Cited

U.S. PATENT DOCUMENTS 3,901,059 A * 8/1975 Nakajima et al. ..... 72/10.6
4,202,192 A * 5/1980 Haneda et al. ..... 72/14.1

* cited by examiner

*Primary Examiner*—Alan Ostrager
*Assistant Examiner*—John S Goetz
(74) *Attorney, Agent, or Firm*—Herbert Dubno

(57) ABSTRACT

Sheet piling and like steel shapes are made in a caliber rolling mill having upper and lower rolls of suitable contour. One of the rolls is axially fixed and the other can be shifted axially in opposite directions so that shoulders of the rolls engage and these positions are stored along with a relationship of axial force and spring constants of the mill frame. The rolling then takes these stored values into consideration.

4 Claims, 3 Drawing Sheets

AXIAL-POSITION ADJUSTMENT FOR PROFILED ROLLING-MILL ROLLS

FIELD OF THE INVENTION

The present invention relates to a rolling-mill stand. More particularly this invention concerns a system for adjusting the relative axial positions of profiled rolls in such a stand.

BACKGROUND OF THE INVENTION

When asymmetrical profiled steel goods, such as rails, sheet piling, guard rails, railroad plates, and the like are produced between a pair of rolls rotating about respective axes, these rolls are subjected not only to considerable radial forces, but to forces tending to displace them axially. Such axial forces can amount to 1000 kN to 2000 kN and can axially shift the rolls and produce a product whose profile is not what was intended.

In order to counter such axial shifting, it is standard to form the profiled rolls with axially oppositely directed annular abutment faces that extend nearly perpendicular, e.g. 87°, to the axis and that can be brought into axial contact with each other, thereby mechanically limiting any axial displacement. Such surfaces are subjected to considerable wear, even when heavily lubricated. Under the best of circumstances, these surfaces wear so that they must be machined down. This reduces their diameter and makes the abutment faces effective again.

It is also possible to simply brace the rolls via massive axial-thrust bearings against the roll-stand frame. Even so considerable elastic deformations of for example 1 mm to 4 mm per 100 kN are encountered due to the numerous elements effectively braced between the cast-iron roll-stand frame and the actual rollers.

This problem becomes somewhat more complex when the workpiece is reversed 180° and sent back through the stand. In this case the axial forces can be additive and thus even more of a problem.

OBJECTS OF THE INVENTION

It is therefore an object of the present invention to provide an improved axial-positioning system for rolling-stand rolls.

Another object is the provision of such an improved axial-positioning system for rolling-stand rolls which overcomes the above-given disadvantages, that is which allows the rolls to be set in a position that will be maintained during the entire rolling operation and that takes into account all of the factors effecting axial roll position.

SUMMARY OF THE INVENTION

These are achieved, in accordance with the invention in a method of rolling a structural shape in a caliber mill or a method of adjusting the relative axial positions of a pair of rolls centered on respective parallel axes in a rolling-stand frame and having respective pairs of axially engageable abutment faces, the method comprising the steps of:

axially displacing one of the rolls in one direction into one end position with one of the pairs of faces pressing axially against other with a predetermined force and then in the opposite direction into an opposite end position with the other of the pairs of faces pressing axially against each other.

The structural shapes with which the invention is applicable include all structural shapes which, during the rolling between the rolling calibers can generate an axial force on the rolls in the direction of one or the other of the axially engageable or abutment faces or shoulders. These structural shapes include sheet piling, guard rails, railroad plates and certain rails, clamping plates mast steel for cranes and, in general, any structural shape including H-beams, I-beams, channels, modified I-beams and Z-shapes. Such structural shapes are also referred to as profiles in the industry.

According to the invention, the structural shape is rolled between the rolling calibers in the finishing operation to size the rolled structural shape. According to the invention, the rollers are axially positioned relatively by:

(a) shifting the one of the rolls axially in one axial direction to press the axially engageable faces on one side of said rolling calibers against each other and shifting that roll axially in an opposite axial direction to press the axially engageable faces on another side of the rolling calibers against each other with a defined force, (b) storing values representing the positions of the one of the rolls upon axial engagement of the faces on each side of the rolling calibers with each other, a value of the axial stroke of the one of the rolls between engagements of the engageable faces on opposite sides of the rolling calibers, and a calculated mean position of the one of the rolls, and shifting the one of the rolls into a caliber-registering position of the rolls of the pair;

(c) then shifting the one of the rolls axially in one axial direction to press the axially engageable faces on one side of the rolling calibers against each other and shifting the one of the rolls axially in an opposite axial direction to press the axially engageable faces on another side of the rolling calibers against each other with incrementally increased forces, and storing respective values of the respective forces, respective values representing the positions of the one of the rolls upon axial engagement of the faces on each side of the rolling calibers with each other at the incrementally increased forces and values of the axial stroke of the one of the rolls between engagements of the engageable faces on opposite sides of the rolling calibers for the incrementally increased forces, and calculating from the stored values a relationship between spring constants of the frames with axial force on the rolls; and (d) during rolling of the structural shape shifting the one of the rolls out of the caliber-registering position by an amount calculated from the spring response of the frames to an expected axial force to be developed during rolling into an actual rolling position, and maintaining the one of the rolls in the actual rolling position with a position controller.

A caliber roll mill according to the invention can comprise:

a mill stand having a pair of opposite mill-stand frames;

a caliber-roll pair including upper and lower caliber rolls journaled at opposite ends in respective ones of the mill-stand frames of a mill stand in respective bearing chocks, corresponding ends of the rolls being located at a service side of the mill stand and at a drive side of the mill stand at which the rolls are driven, the rolls having respective juxtaposed rolling calibers generating axial forces on the rolls upon rolling a structural shape between them and axially engageable faces flanking the rolling calibers, one of the rolls being axially shiftable relative to the other of the rolls, the one of the rolls having a roll stub at the service side;

a thrust bearing having inner rings on the stub and outer rings;

a piston receiving the outer rings;

a cylinder formed in a respective one of the bearing chocks receiving the piston and provided with means for pressurizing the piston on axially opposite sides thereof for displacing the one of the rolls axially in opposite directions; and a displacement-measurement device mounted on the cylinder for measuring axial displacement of the piston.

The system used for controlling the axial positioning of the rolls can include a computer for:

(a) storing values representing the positions of the one of the rolls upon axial engagement of the faces on each side of the rolling calibers with each other, a value of the axial stroke of the one of the rolls between engagements of the engageable faces on opposite sides of the rolling calibers, and a calculated mean position of the one of the rolls, and shifting the one of the rolls into a caliber-registering position of the rolls of the pair;

(b) then shifting the one of the rolls axially in one axial direction to press the axially engageable faces on one side of the rolling calibers against each other and shifting the one of the rolls axially in an opposite axial direction to press the axially engageable faces on another side of the rolling calibers against each other with incrementally increased forces, and storing respective values of the respective forces, respective values representing the positions of the one of the rolls upon axial engagement of the faces on each side of the rolling calibers with each other at the incrementally increased forces and values of the axial stroke of the one of the rolls between engagements of the engageable faces on opposite sides of the rolling calibers for the incrementally increased forces, and calculating from the stored values a relationship between spring constants of the frames with axial force on the rolls; and (c) during rolling of the structural shape shifting the one of the rolls out of the caliber-registering position by an amount calculated from the spring response of the frames to an expected axial force to be developed during rolling into an actual rolling position, and maintaining the one of the rolls in the actual rolling position.

The method and rolling mill of the invention has been found to reduce wear, minimize the usage and need for lubricant and has the further advantage of maintaining the caliber rolls practically continuously in such registry that high quality profiled products can be obtained, especially when, during the rolling of these products, there is a rotation of the stock between the reversing passes.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
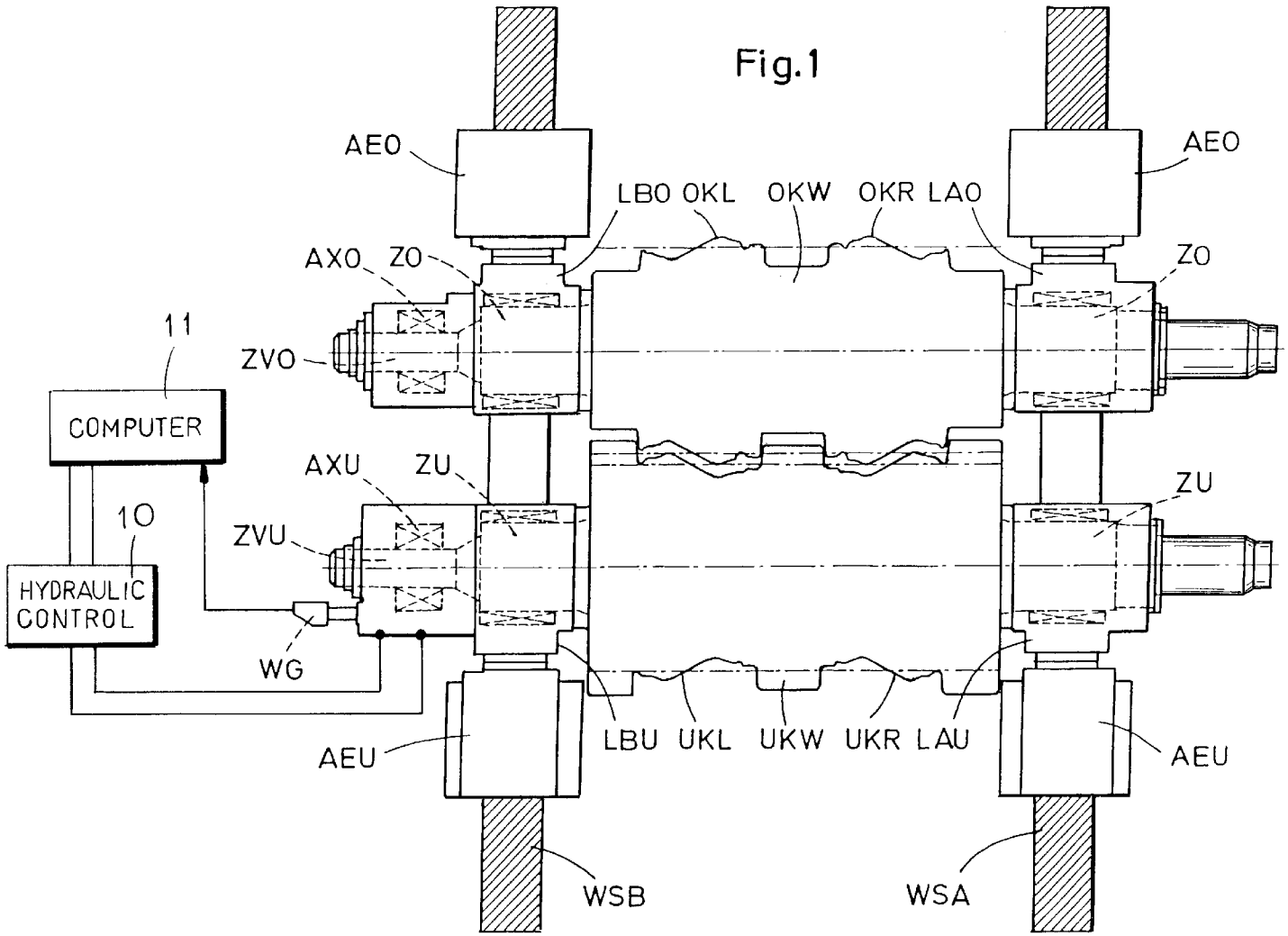
FIG. 1 is a vertical section through a caliber rolling mill, illustrated somewhat diagrammatically.

As can be seen from FIG. 1, a caliber mill stand for use in a final rolling stage of a profiled product or structural shape as described, for example, a sheet pile, can comprise a drive side roll-stand frame WSA and a service side frame WSB. In the surface side frame WSB, bearing chocks LBO and LBU for the upper and lower rolls are provided while in the drive side frame WSA, bearing chocks LAO and LAU are provided, the bearing chocks being vertically displaceable and co-operating with vertical adjusting devices AEO and AEU to raise and lower the bearing chocks and thereby control the rolling gap. In the bearing chocks LBO and LAO, the shaft ends or stubs ZO of the upper caliber roll OKW are journalled.

Both caliber rolls OKW and UKW have two rolling calibers OKL and OKR or UKL and UKR which are juxtaposed with one another to form the rolling gaps through which the stock passes.

The surface side stubs ZO and ZU of the rolls have stub extensions ZVO or ZVU which are provided with axial or thrust bearings AXO or AXU.

Figure 2:
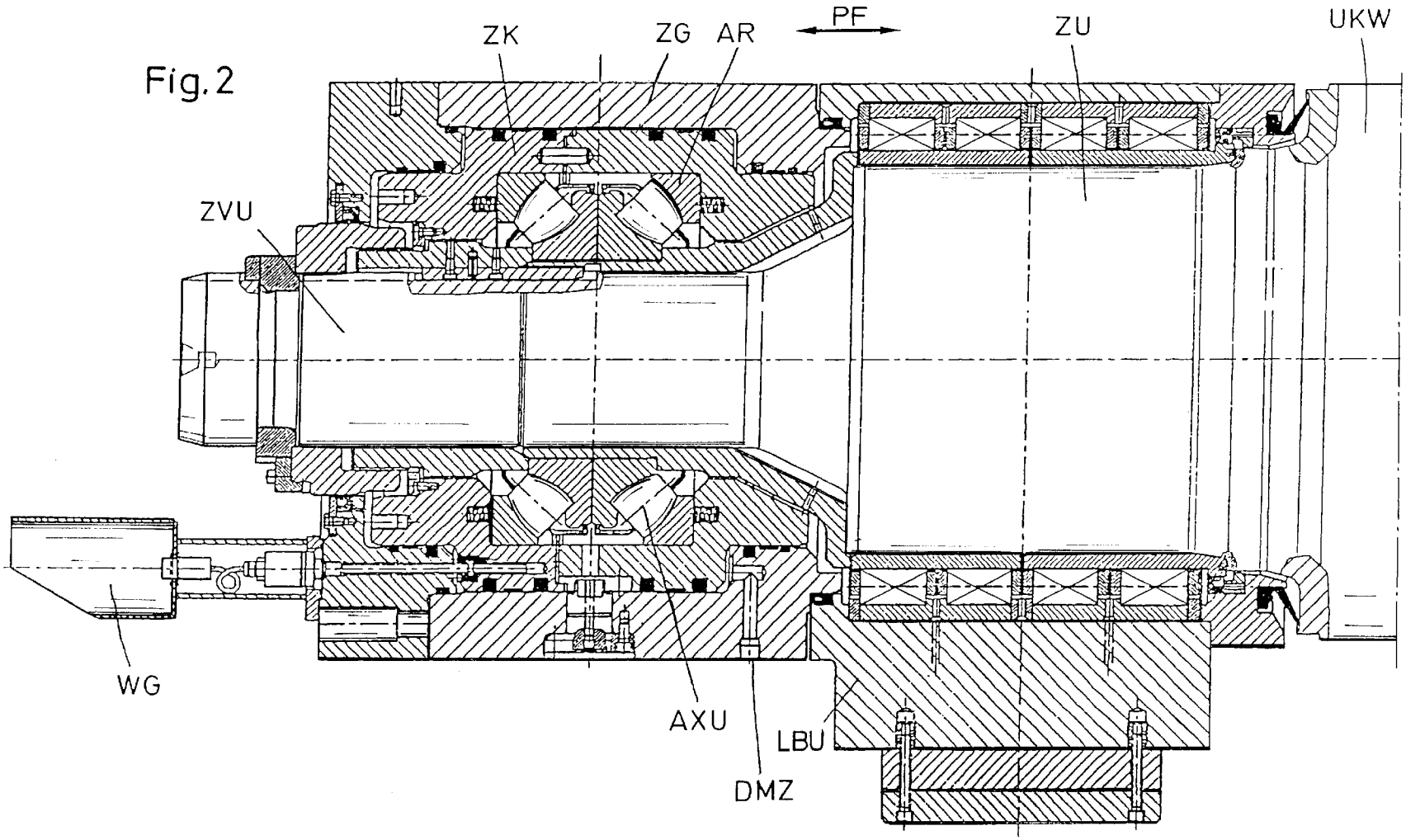
FIG. 2 is an axial section through the bearing chock and bearing assembly at the service side of the axially shiftable caliber roll.

The outer ring AR of the thrust bearing AXU of the lower caliber roll UKW (see FIG. 2) is received in a piston ZK which is axially shiftable in a cylinder housing ZG and can be pressurized on both axial sides by hydraulic fittings DMZ to shift the piston and thus the roll in both axial directions as represented by the double headed arrow PF in FIG. 2. A hydraulic control 10 operated by the computer 11 is provided for this purpose.

On the cylinder housing ZG and connected with the piston ZK is a position indicator WG which can provide an input to the computer and can allow the computer to act as a position maintainer for the lower roll. The device WG can also provide an input to the computer of the position of the lower roll and feedback from the hydraulic system can provide the computer with measurements of the axial force with which the lower roll bearings to the right and to the left respectively.

Figure 3:
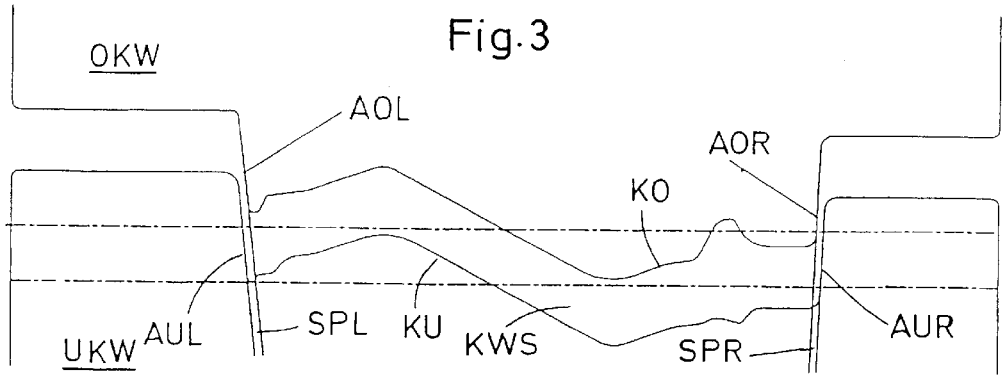
FIGS. 3 to 6 are details showing the relative positions of the rolls to an enlarged scale by comparison with FIG. 1 and illustrating the method of the invention.
Figure 4:
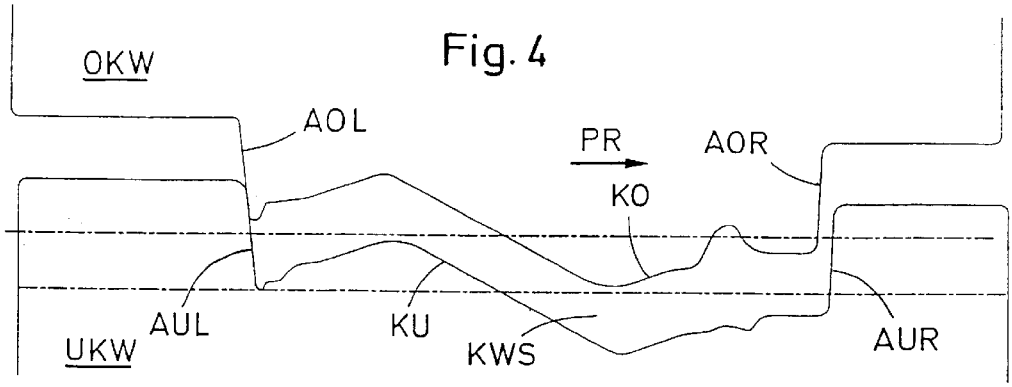
Figure 5:
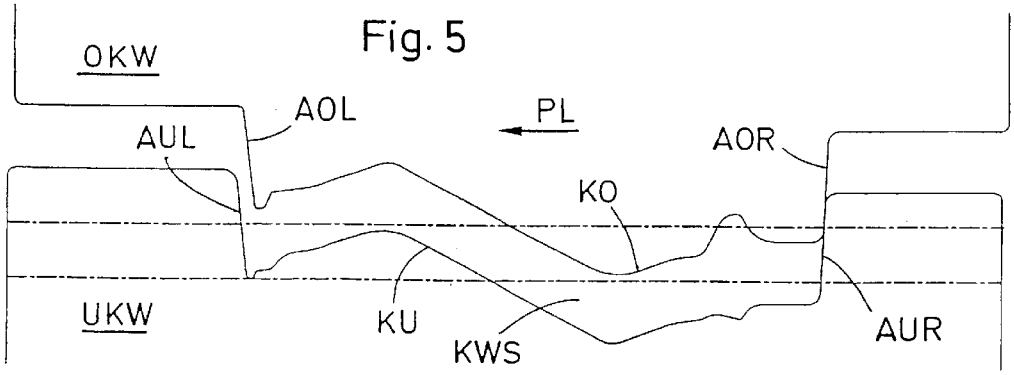

From FIG. 3, it will be apparent that the rolling caliber KO of the upper roll OKW and the lower rolling caliber KU of the lower caliber roll UKW define the rolling gap KWS for the product to be made. On both sides of the rolling calibers are steeply inclined abutment faces or shoulders AOL and AOR on the lower roll. Between these faces assuming position of the lower roll in its main position, equal width gaps SPL and SPR can form. As can be seen from FIGS. 4 and 5, the lower roll UKW is first moved to the right until the faces AOL and AUL engage with a predetermined force or load, i.e. by movement in the direction of arrow PR to the right (FIG. 4) and then is moved to the left (arrow PL) to bring the engaging faces AOR and AUR into abutment at the same force. The axial displacement of the lower roll, the positions of the lower roll upon each engagement of the faces and the value of the pressure or force are stored. With incremental changes in the force or pressure, the values are again stored and the spring constants of the frames WSA and WSB are calculated.

Figure 6:
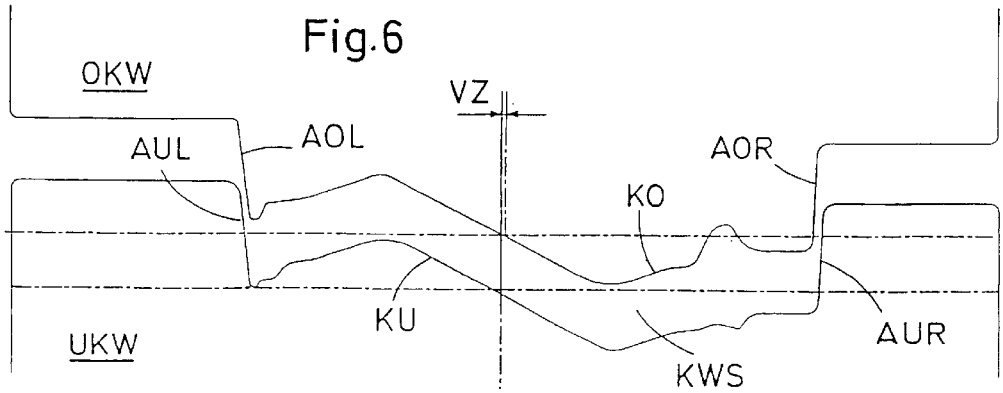

FIG. 6 shows that with the aid of the results stored in the memory of the computer 11, an axial offset VZ of the lower roll UKW from its exact registry position of the roll calibers can be provided to counteract the axial force expected from the rolling operation for the ongoing rolling process.

We claim:

1. A method of rolling a structural shape in a caliber roll mill having a caliber-roll pair including upper and lower caliber rolls journaled at opposite ends in respective mill-stand frames of a mill stand with respective bearing chocks, corresponding ends of said rolls being located at a service side of said mill stand and at a drive side of said mill stand at which said rolls are driven, said rolls having respective juxtaposed rolling calibers generating axial forces on said rolls upon rolling a structural shape between them and axially engageable faces flanking said rolling calibers, one of said rolls being axially shiftable relative to said other of said rolls, said method comprising said steps of:

rolling a structural shape between said rolling calibers to size said rolled structural shape; and axially positioning said rolls relatively by:

(a) shifting said one of said rolls axially in one axial direction to press said axially engageable faces on one side of said rolling calibers against each other and shifting said one of said rolls axially in an opposite axial direction to press said axially engageable faces on another side of said rolling calibers against each other with a defined force, (b) storing values representing said positions of said one of said rolls upon axial engagement of said faces on each side of said rolling calibers with each other, a value of said axial stroke of said one of said rolls between engagements of said engageable faces on opposite sides of said rolling calibers, and a calculated mean position of said one of said rolls, and shifting said one of said rolls into a caliber-registering position of said rolls of said pair;

(c) then shifting said one of said rolls axially in one axial direction to press said axially engageable faces on one side of said rolling calibers against each other and shifting said one of said rolls axially in an opposite axial direction to press said axially engageable faces on another side of said rolling calibers against each other with incrementally increased forces, and storing respective values of said respective forces, respective values representing said positions of the one of said rolls upon axial engagement of said faces on each side of said rolling calibers with each other at said incrementally increased forces and values of said axial stroke of said one of said rolls between engagements of said engageable faces on opposite sides of said rolling calibers for said incrementally increased forces, and calculating from said stored values a relationship between spring constants of said frames with axial force on said rolls; and (d) during rolling of said structural shape shifting said one of said rolls out of said caliber-registering position by an amount calculated from the spring response of said frames to an expected axial force to be developed during rolling into an actual rolling position, and maintaining said one of said rolls in said actual rolling position with a position controller.

2. A caliber roll mill comprising:

a mill stand having a pair of opposite mill-stand frames;

a caliber-roll pair including upper and lower caliber rolls journaled at opposite ends in respective ones of said mill-stand frames of a mill stand in respective bearing chocks, corresponding ends of the rolls being located at a service side of the mill stand and at a drive side of the mill stand at which the rolls are driven, the rolls having respective juxtaposed rolling calibers generating axial forces on said rolls upon rolling a structural shape between them and axially engageable faces flanking said rolling calibers, one of said rolls being axially shiftable relative to the other of said rolls, said one of said rolls having a roll stub at said service side;

a thrust bearing having inner rings on said stub and outer rings;

a piston receiving said outer rings;

a cylinder formed in a respective one of said bearing chocks receiving said piston and provided with means for pressurizing said piston on axially opposite sides thereof for displacing said one of said rolls axially in opposite directions; and a displacement-measurement device mounted on said cylinder for measuring axial displacement of said piston; and a computer programmed for (a) storing values representing the positions of said one of said rolls upon axial engagement of said faces on each side of said rolling calibers with each other, a value of the axial stroke of said one of said rolls between engagements of the engageable faces on opposite sides of the rolling calibers, and a calculated mean position of said one of said rolls, and shifting said one of said rolls into a caliber-registering position of the rolls of the pair;

(b) then shifting said one of said rolls axially in one axial direction to press the axially engageable faces on one side of said rolling calibers against each other and shifting said one of said rolls axially in an opposite axial direction to press the axially engageable faces on another side of said rolling calibers against each other with incrementally increased forces, and storing respective values of the respective forces, respective values representing the positions of said one of said rolls upon axial engagement of said faces on each side of said rolling calibers with each other at the incrementally increased forces and values of the axial stroke of said one of said rolls between engagements of the engageable faces on opposite sides of the rolling calibers for the incrementally increased forces, and calculating from the stored values a relationship between spring constants of the frames with axial force on said rolls; and (c) during rolling of said structural shape shifting said one of said rolls out of said caliber-registering position by an amount calculated from the spring response of said frames to an expected axial force to be developed during rolling into an actual rolling position, and maintaining said one of said rolls in said actual rolling position.

3. The caliber roll mill defined in claim 2, further comprising a position controller for maintaining said one of said rolls in said actual rolling position.

4. A shiftable roll for a rolling mill for practicing the rolling method of claim 1 which comprises a rolling body (UKW) having a stub extension (ZVU) of a stub (ZU) onto which an axial bearing (AXU) is fitted, the axial bearing (AXU) having an outer ring (AR) which is received in a piston (ZK) shiftable by fluid pressure axially in opposite directions in a cylinder housing (ZG) on which is mounted a position indicator (WG) connected to the piston (ZK).

* * * * *